US005896635A

United States Patent [19]

Marlow et al.

[11] Patent Number: 5,896,635

[45] Date of Patent: Apr. 27, 1999

[54] APPARATUS FOR FORMING EXPANDED MESH

[75] Inventors: John V. Marlow, Oakville; Rajindra Singh, Mississauga, both of Canada

[73] Assignee: Cominco Ltd., Vancouver, Canada

[21] Appl. No.: 08/863,551

[22] Filed: May 27, 1997

[51] Int. Cl.[6] ..... B21D 31/04

[52] U.S. Cl. ..... 29/6.1; 29/6.1; 72/186; 72/187

[58] Field of Search ..... 29/6.1

[56] References Cited

U.S. PATENT DOCUMENTS 3,763,616 10/1973 Pastorelli et al. ..... 29/6.1
3,774,274 11/1973 Jury ..... 29/6.1
4,315,356 2/1982 Marlow .
4,621,397 11/1986 Schrenk ..... 29/6.1
4,807,336 2/1989 Yoshimura et al. ..... 26/73
5,093,971 3/1992 Hein ..... 29/6.1

*Primary Examiner*—Paul T. Sewell
*Assistant Examiner*—John Preta
*Attorney, Agent, or Firm*—Arne I. Fors

[57] ABSTRACT

An apparatus for gripping, guiding and transporting opposite longitudinal side edges of slit, deformable strip for forming expanded mesh sheet. One chain of each of two pairs of opposed endless chains has a longitudinal recess adjacent a longitudinal planar side edge of the strip for receiving the planar edge of the strip therein and the opposed chain of each of said pairs has a plurality of equispaced sharp projections for penetrating the longitudinal planar side edge of the strip whereby the said edge is effectively gripped between the opposed chains during expansion.

15 Claims, 8 Drawing Sheets

APPARATUS FOR FORMING EXPANDED MESH

BACKGROUND OF THE INVENTION (i) Field of The Invention

This invention relates to the production of expanded metal strip and, more particularly, relates to an apparatus for gripping opposite longitudinal side edges of slit metal strip and advancing said longitudinal side edges in diverging paths for progressively laterally expanding the strip.

(ii) Description of the Related Art

A method and apparatus for forming expanded mesh sheets from deformable metal strip in which the strip is slit and pre-formed and then laterally expanded to form expanded mesh sheet is disclosed in U.S. Pat. No. 4,315,356 granted to Cominco Ltd. on Feb. 16, 1982, incorporated herein by reference. This patent discloses the forming of an upturned edge on each lateral side edge of strip to be expanded, engaging said upturned edge on each side of said strip between a pair of opposed endless chains having an internal longitudinal slot formed therein for receiving said upturned edge, and advancing said edges in laterally diverging paths by travel of said endless chains whereby the strip is progressively laterally expanded. More recently, preform protrusions have been formed adjacent each longitudinal side edge for engagement in internal longitudinal slots in the opposed endless chains. Once expansion of the metal strip is complete, a major portion of each outer longitudinal side edge of the strip containing the upturned edges or preform protrusions becomes superfluous and must be slit and discarded as scrap in order to leave a minimum width of border, if desired, for the final product. This necessitates an undesirable ancillary chopping and trimming operation and recycle of scrap with attendant losses due to creation of dross because of the presence of contaminants such as lubricating oils which must be skimmed and discarded.

It is a principal object of the present invention to provide a method and apparatus for expanding slit metal strip by gripping, guiding and transporting the opposite longitudinal side edges of the strip in diverging paths for progressively laterally expanding the strip without the need of upturned side edges, flanges, or preformed protrusions formed in the longitudinal side edges of the strip, thereby obviating an edge preforming operation and an edge slitting operation which will not only reduce equipment requirements and costs for slitting, guiding, chopping, conveying, storing and remelting steps but will also result in a reduction of about 50% or more of scrap material, depending on grid design, with a significant reduction of metal losses in lead dross.

Another important object of the invention is quick and easy access to apparatus components in a production environment for replacement of components to compensate for changes in handling characteristics of lead alloys ranging from soft low strength alloys to hard high strength alloys.

SUMMARY OF THE INVENTION

In its broad aspect, the apparatus of the invention for expanding slit metal strip having opposite, longitudinal planar side edges in which gripping and guiding means engage the opposite longitudinal side edges of the strip and advance said edges in diverging paths for progressively laterally expanding the strip comprises two spaced apart pairs of diverging, opposed endless chains, one chain in each pair of opposed endless chains having a longitudinal recess adjacent a longitudinal planar side edge of the strip for receiving the longitudinal planar side edge of the strip therein, and the opposed chain in the said pair of opposed endless chains having a plurality of spaced sharp projections extending partially into the longitudinal recess for penetrating and gripping the longitudinal side edge of the strip whereby the longitudinal planar side edges of the strip are advanced in diverging lateral paths for expanding the strip.

Each chain in each pair of opposed endless chains is a multiple link chain, preferably having six or eight parallel side-by-side links. The longitudinal recess for receiving the planar side edge of the strip may be one or two links wide or more depending on grid design and size. For example, large industrial grids may require a longitudinal recess three links wide.

The spaced sharp projections preferably are equispaced and may be in the shape of v-shaped teeth having an acute included angle of about 45° to about 60°, or may be in the shape of teeth having a knife edge. The teeth are shorter than the depth of the opposed recess to provide a clearance between the teeth and opposed chain. For a ⅜ inch pitch chain, a clearance of at least 0.010 inch is required, the teeth preferably having a length of about 0.060 inch and the recess having a depth of about 0.070 inch. Larger chain pitches required for industrial grids may have a larger clearance between the teeth and the opposed chain.

The apparatus of the invention includes a pair of opposed, spaced-apart guide bars mounted on each side of a frame for receiving a pair of said diverging, opposed endless chains for guided travel, means for rigidly mounting one of said guide bars on the frame, and means for resiliently mounting the other of said guide bars on the frame for biasing one of the said guide bars towards the other. The means for resiliently mounting the other of said guide bar comprises a stationary guide member rigidly mounted on the frame spaced from and parallel to the resiliently-mounted guide bar, said stationary guide member having a guide wall extension for laterally positioning and supporting the resiliently-mounted guide bar and having a plurality of holes equispaced along the length of the stationary guide member, and a cap mounted on the stationary guide bar member having a plurality of holes, matching the holes equispaced along the stationary guide member. A bolt loosely mounted in each hole is threaded into the guide bar and a compression spring positioned in each said hole concentric with the bolt abuts the cap at one end, whereby the resiliently-mounted guide bar is normally biased by the compression spring towards the stationary guide bar upon loosening of the bolts, and the resiliently-mounted guide bar is retracted away from the stationary guide bar by screwing of the bolts into the said resiliently-mounted guide bar.

The cap is removable for external access to and for replacement of the compression springs.

BRIEF DESCRIPTION OF THE DRAWINGS

The apparatus of the invention will now be described with reference to the accompanying drawings, in which.

DESCRIPTION OF THE PREFERRED EMBODIMENTS

Figure 1:
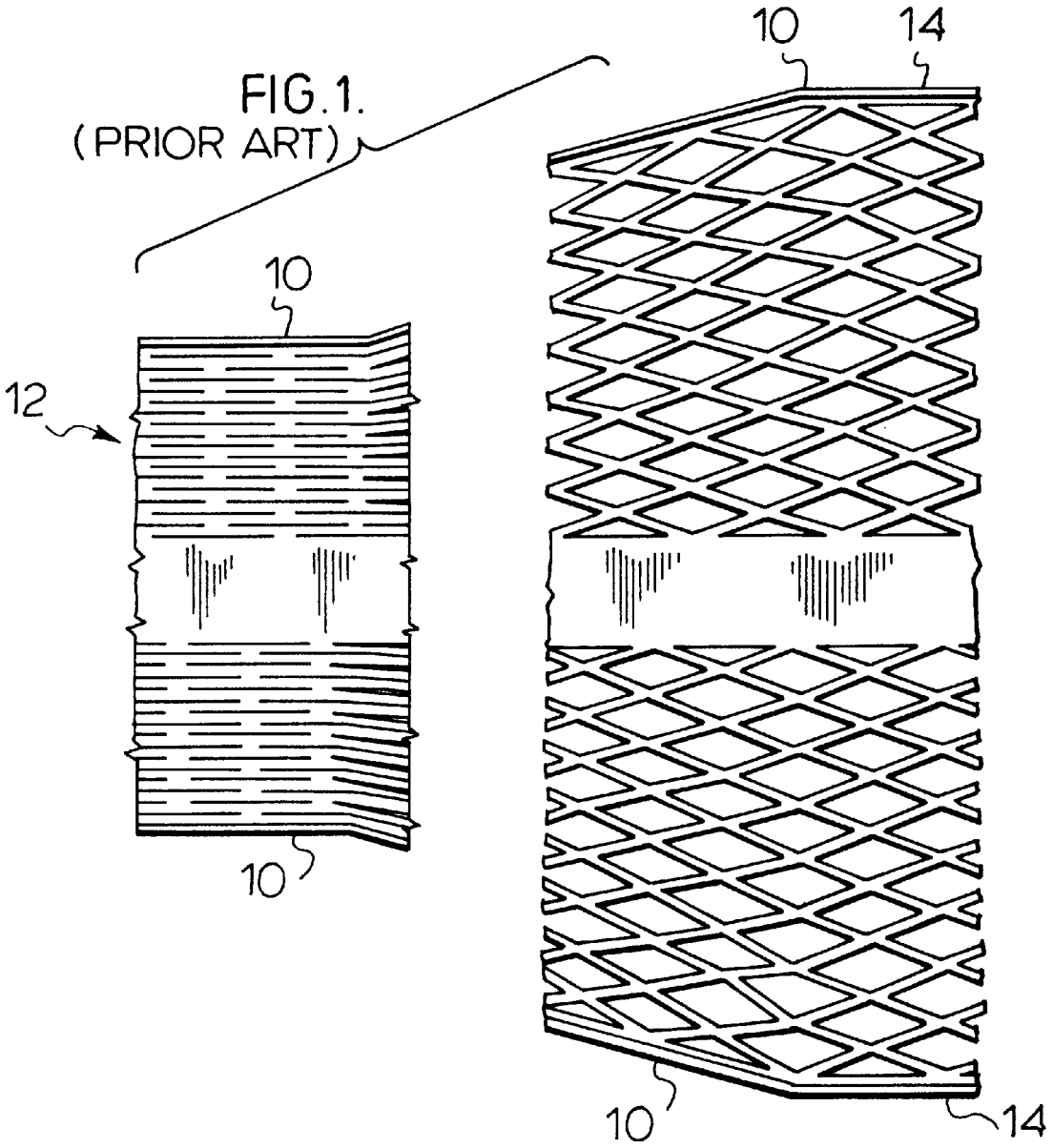
FIG. 1. (PRIOR ART)
FIG. 1 is a plan view of strip produced according to the prior art method and the apparatus of U.S. Pat. No. 4,315,356 in which upturned longitudinal side edges of strip are engaged by opposed endless chains.

With reference first to the prior art shown in FIG. 1 of the drawings, lateral side edges 10 of strip 12 have narrow, upturned flanges 14 or double pitch edge preform protrusions, not shown, adapted to be engaged by internal slots or recesses in the links of multiple link chains of a pair of opposed endless chains. Trimming of the deformed side edges of the strip at the completion of strip expansion necessitates the installation and use of trimming and chopping equipment and constitutes a significant waste of strip material as scrap with attendant costs of trimming, conveying and chopping the scrap for recycle.

Figure 2:
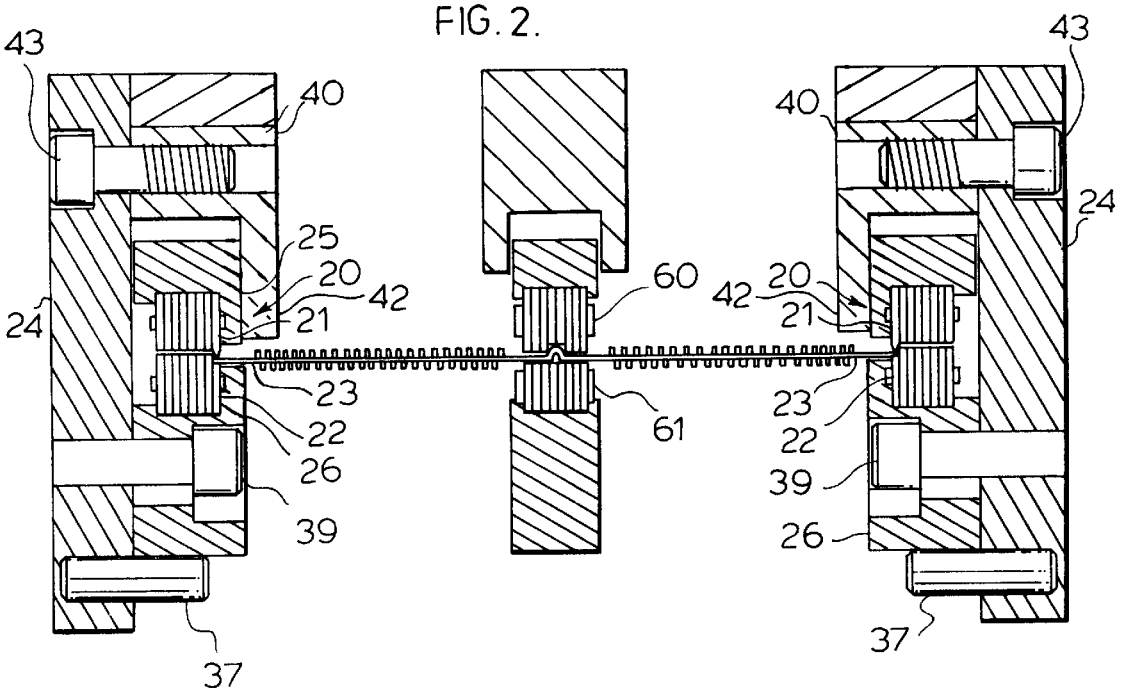
FIG. 2 is an fragmentary cross-sectional view of the apparatus of the present invention with preformed strip preparatory to expansion.
Figure 3:
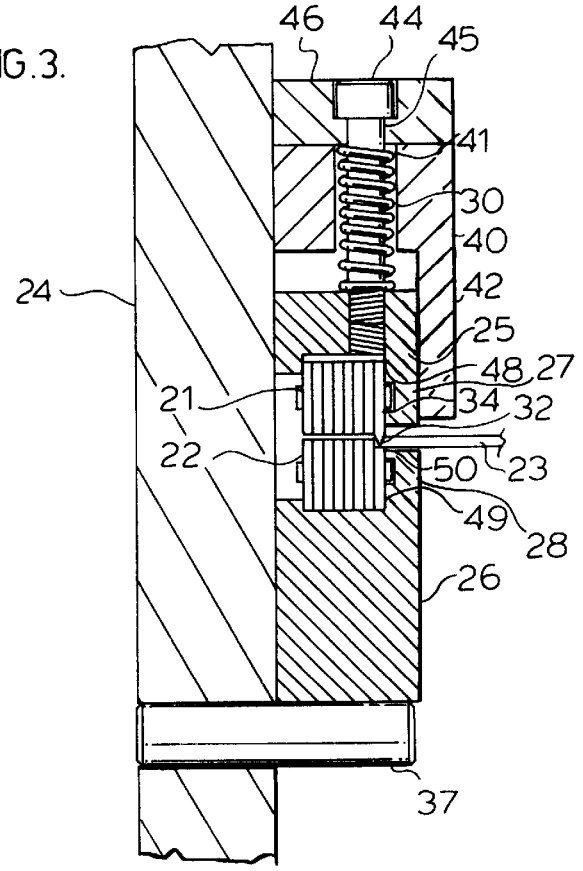
FIG. 3 is an enlarged fragmentary cross-sectional view, partly in elevation, of a pair of opposed chains on the left side of the apparatus shown in FIG. 2.
Figure 4:
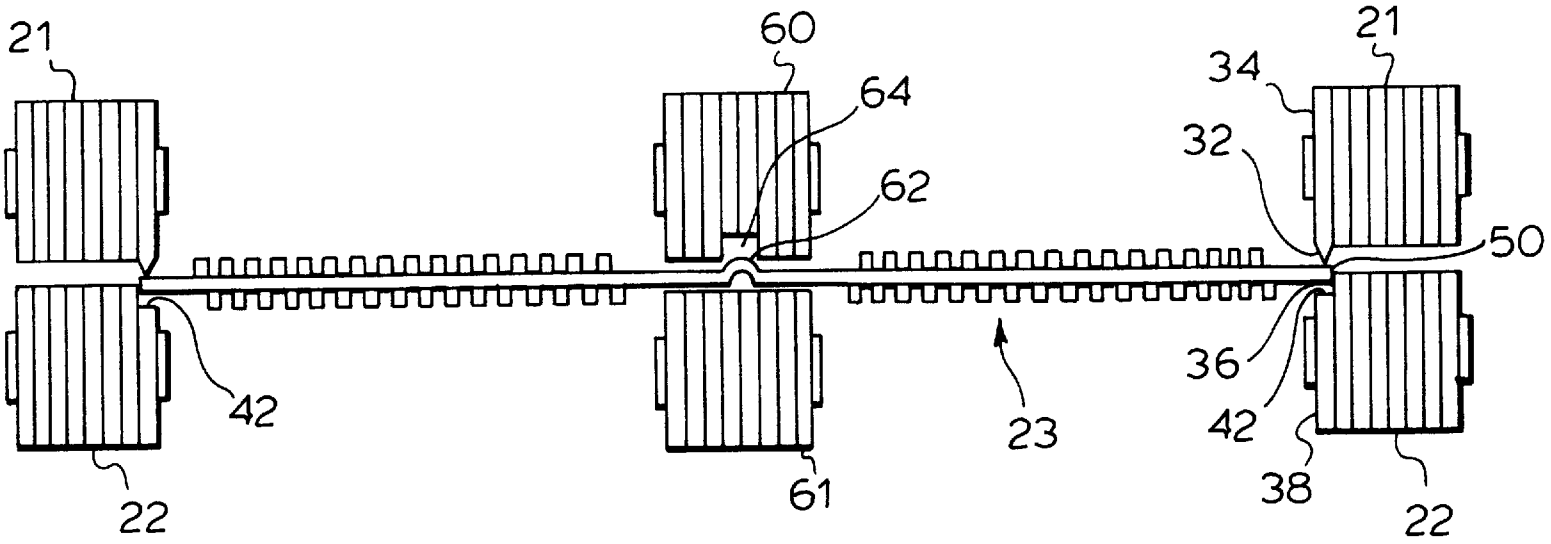
FIG. 4 is an enlarged illustration of the endless chains of the invention with trip shown in FIG. 2, in which the opposed chains are separated for clarity of description.

Turning now to the embodiment of the invention shown in FIGS. 2 and 3 of the drawings, two pairs 20 of opposed multiple link endless chains 21, 22 of the present invention are mounted for continuous linear travel at each longitudinal side edge of strip 23. Chains 21, 22 are supported on frame 24 by upper and lower hardened tool steel guide bars 25, 26 respectively for accurate alignment and tracking of the chains, and are driven by a drive motor, not shown, with a phase adjuster for synchronous travel of the upper chain 21 relative to lower chain 22.

Figure 5:
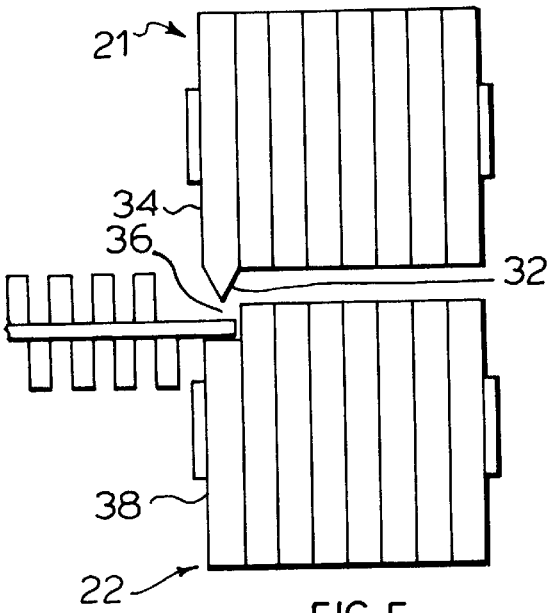
FIG. 5 is a further enlarged schematic view of the opposed chains shown to the right in FIG. 4.

With particular reference now to FIGS. 3 and 5, chains 21, 22 travel in guide bars 25, 26 respectively, preferably with one of the chains, upper chain 21 in this embodiment, resiliently urged downwardly against lower chain 22 by a plurality of normally equispaced coiled die compression springs 30, one of which is shown, biased against the back side of upper guide bar 25. Teeth 32, normally depending downwardly from the link 34 of chain 21, are biased to project downwardly into a recess 36 defined by opposed shortened link 38 of chain 22.

Lower guide bar 26 is positioned by dowel reference pin 37 and is rigidly fixed to frame 24 by bolts 39 (FIG. 2). Upper stationary guide member 40 having guide wall extensions 42 for laterally positioning floating guide bar 25 is secured to frame 24 by bolts 43. Bolts 44 (FIG. 3) project downwardly loosely through equispaced holes 41 having shoulders 45 formed in cap 46 and through fixed guide-member 40 concentric with springs 30 for threading into guide bar 25. Bolts 44 normally are retracted sufficiently from guide bar 25 to allow the guide bar to float under the downward bias of springs 30. Bolts 44 can be screwed inwardly into guide bar 25 whereby the heads of bolts 44 abut hole shoulders 45 to retract the guide bar to release upper and lower chains 21, 22 from the longitudinal recesses 48, 49 in guide bars 25, 26 respectively for servicing or replacement.

Figure 6:
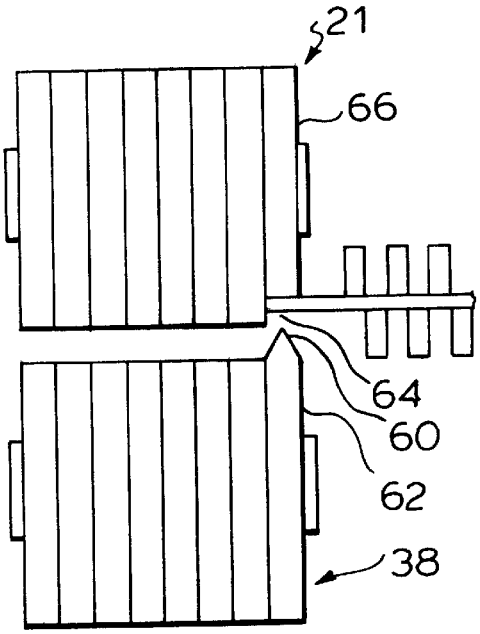
FIG. 6 is an enlarged schematic view corresponding to FIG. 5 of an embodiment of the invention with teeth projecting upwardly from links of a lower opposed chain.
Figure 7:
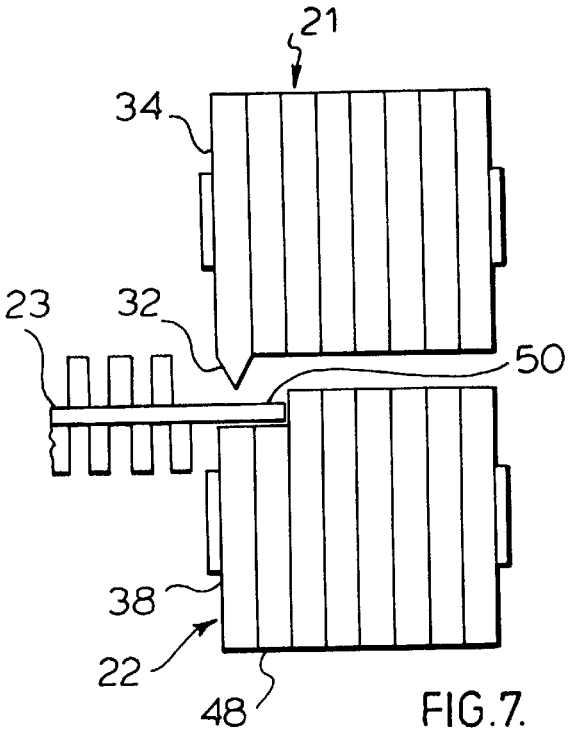
FIG. 7 is a schematic illustration of another embodiment of the chains of the present invention.

With reference now to FIGS. 5 through 8, embodiments of gripping and guide teeth are illustrated schematically. FIGS. 5 and 7 illustrate sharp, V-shaped teeth 32 formed in upper inner link 34 of chain 21 with a mating recess 36 formed in opposed lower link 38 of lower chain 22 to receive teeth 32. Each V-shaped tooth 32 is sharpened to define an acute included angle between about 45° and about 60° terminating in a sharp-edged point positioned slightly above the opposed face 42 of lower link 38 to ensure clearance of the opposed links if the chains are operated without the presence of strip. In practice, by way of illustration, for a ⅜ inch chain pitch, the V-shaped teeth 32 can have a length to extend about 0.060 inch downwardly beyond the plane of upper chain 21 and the opposed shortened guide link 38 can define a recess of about 0.070 inch below the plane of the adjacent links of the lower chain 22 to provide a clearance of about 0.010 inch between the links. Each link 38 for a ⅜ inch pitch chain has a width of 0.060 inch, allowing a 0.030 inch bite (FIGS. 5 and 6) of each tooth 32 into planar edge 50 of strip 23 from the outside edge thereof.

FIG. 6 shows one of a plurality of upstanding equispaced lower V-shaped teeth 60 formed in lower inner link 62 of chain 38 with mating recesses 64 formed in opposed upper inner link 66 of chain 21 to receive teeth 60.

FIG. 7 illustrates schematically an embodiment of our invention in which a pair of lower links 38, 48 are shortened to allow planar edge 50 of strip 23 to extend deeper between the opposed chains to provide a bite of 0.090 inch. Although a pair of links 38, 48 are shown shortened, it will be understood that one, two or three or more links may be shortened depending on the desired bite.

Figure 8:
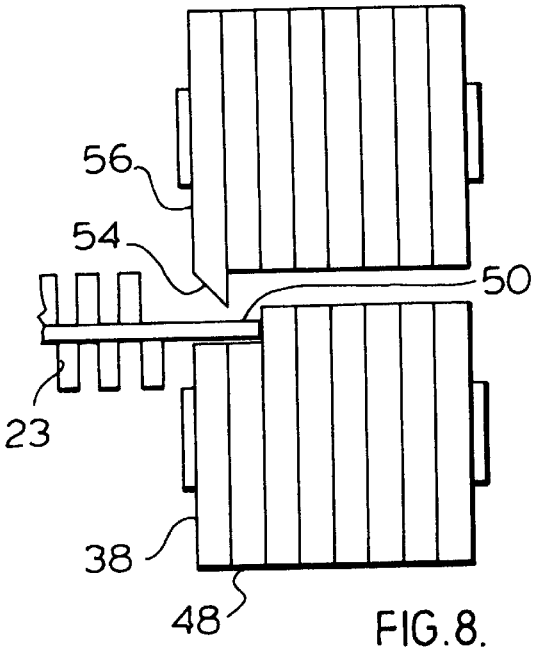
FIG. 8 is a schematic view of a still further embodiment of the invention.

FIG. 8 illustrates a further embodiment of our invention in which a pair of lower links 38, 48 are shortened to allow the planar edge 50 of sheet 23 to be gripped by chisel-shaped teeth 54 of links 56. A bite of 0.060 " is provided.

Figure 9:
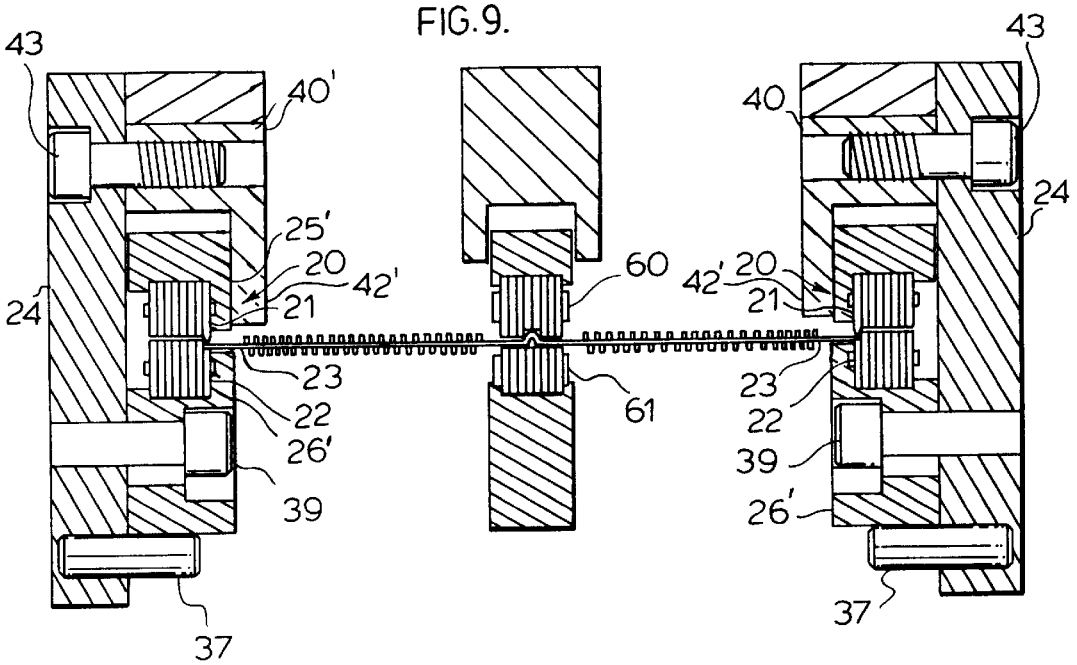
FIG. 9 is a cross-sectional view of another embodiment of the apparatus of the invention.
Figure 10:
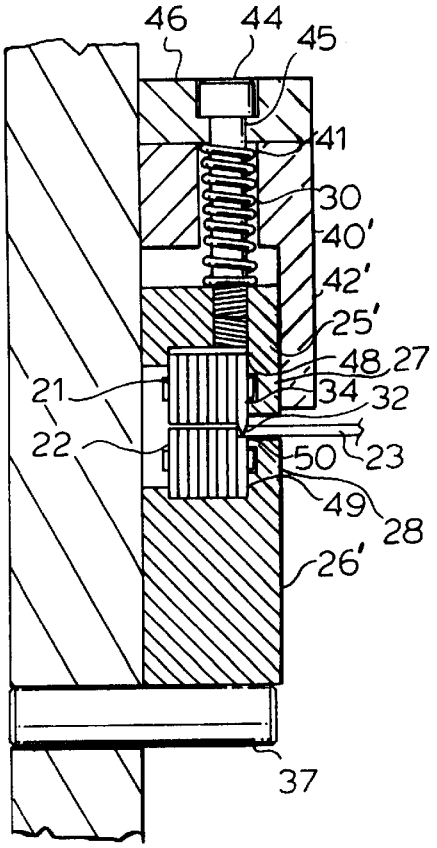
FIG. 10 is an enlarged fragmentary cross-sectional view, partly in elevation, of the left portion of the apparatus shown in FIG. 9.

With reference now to the embodiment of the invention shown in FIGS. 9 and 10, upper guide bar 25' has a downward side extension 27 for providing lateral support to chain 21 during expansion of the strip. Lower guide bar 26' may have an upward side extension 28 for providing lateral support to lower chain 22 if the embodiment shown in FIG. 6 is used. Upper stationary guide bar 40' has an elongated guide wall extension 42' to laterally support side extension 27.

In operation, and with particular reference to FIGS. 2, 3, 4, 8, 9 and 10, strip 23 is centered between the spaced-apart merging pairs of opposed chains 21, 22 at the entry of the expander by pressure engagement between opposed endless chains 60, 61 positioned centrally between the two pairs of opposed chains. Strip 23 has a longitudinally-extending central ridge 62 adapted to seat in mating longitudinal recess 64 in upper chain 60 for accurate locating of strip 23 between the outer sets of expansion chains 21, 22.

The opposite longitudinal side edges 50 of strip 23 are slightly penetrated by teeth 32 (or teeth 54), under the bias of upper guide bar 25, or 25' and the side edges 50 of the strip are progressively spread apart for expansion of the strip into an open mesh pattern as the strip is advanced through the expander.

Figure 11:
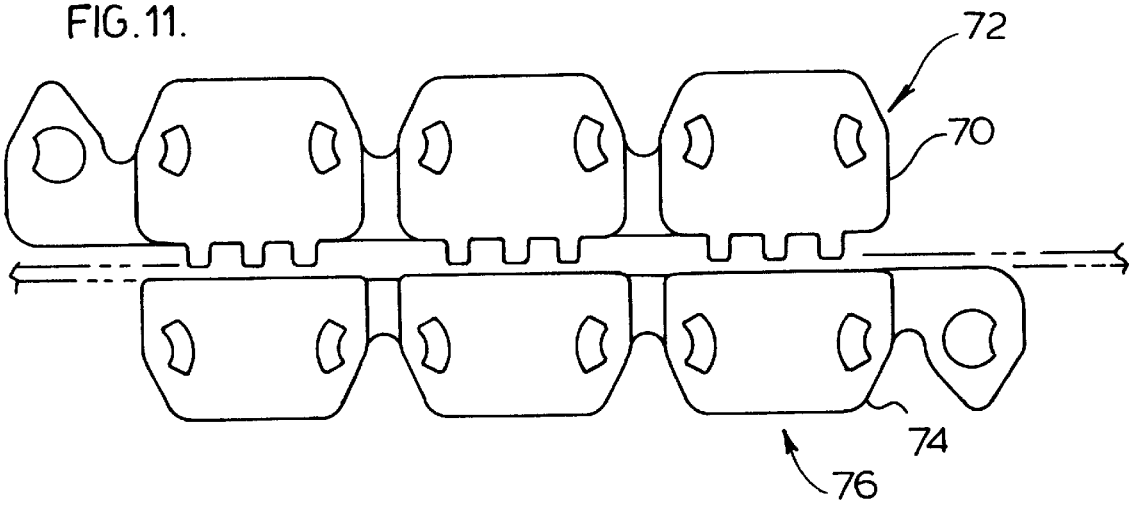
FIG. 11 is a side elevation of a pair of opposed chains in phase, i.e. the links in one chain are opposite the links in the other chain.
Figure 12:
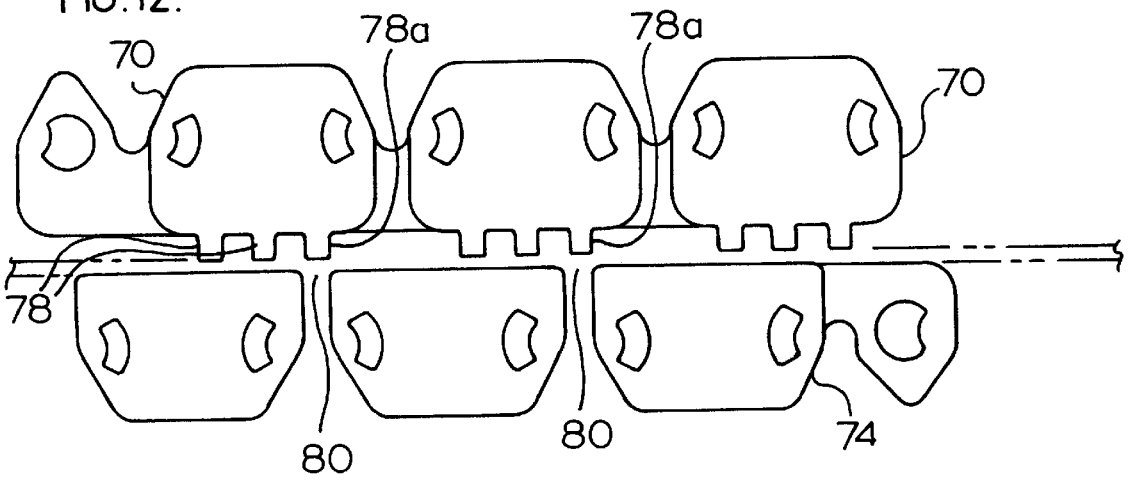
FIG. 12 is a side elevation of a pair of opposed chains out of phase.

FIGS. 11 and 12 illustrate conventional link spacing, FIG. 11 showing links 70 of upper chain 72 in phase with and opposed to links 74 of lower chain 76 and FIG. 12 showing links 70 of upper chain 72 out-of-phase with links 74 of lower chain 76. Each tooth 78*a* of teeth 78 depending downwardly from links 70 are opposite spaces 80 between links 74, possibly causing the strip gripped by teeth 78*a* to be depressed into spaces 80, thereby deforming the edges of the strip and causing an undesired wavy edge which will become the bottom frame of a finished battery plate.

Figure 13:
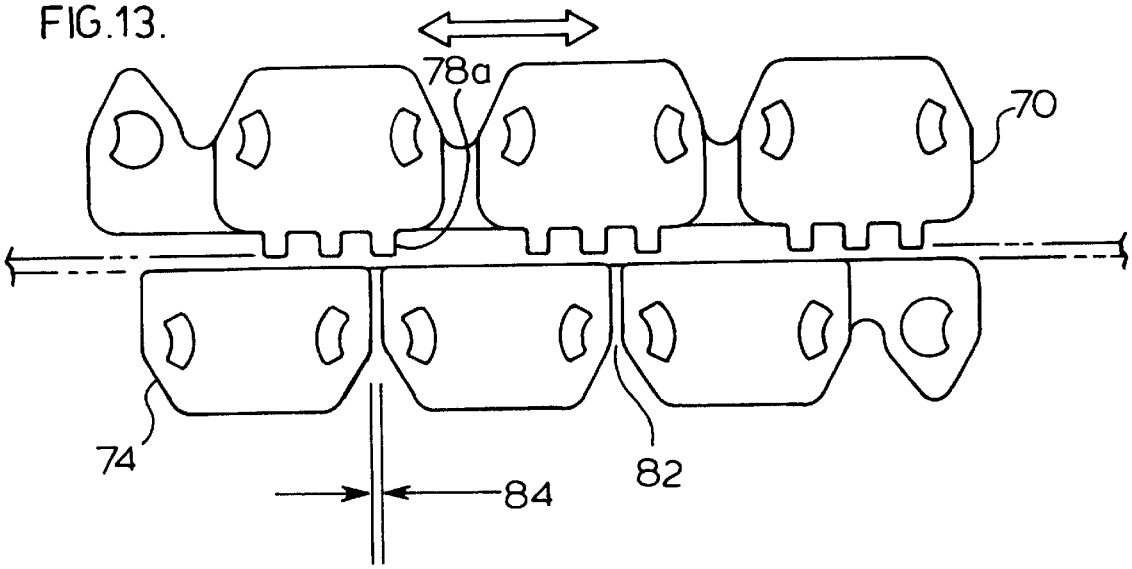
FIG. 13 is a side elevation of a pair of opposed chains out of phase in which the linear spacing of the links of the lower chain is less than the width of the teeth of the upper chain.

It has been found that narrowing of the spaces between links 74 to form gaps 82 narrower than the width of teeth 78, such as depicted in FIG. 13 by numeral 84, prevents teeth 78 or 78*a* from deforming the strip. This is particularly significant for soft metal alloys which are prone to deformation.

Figure 14:
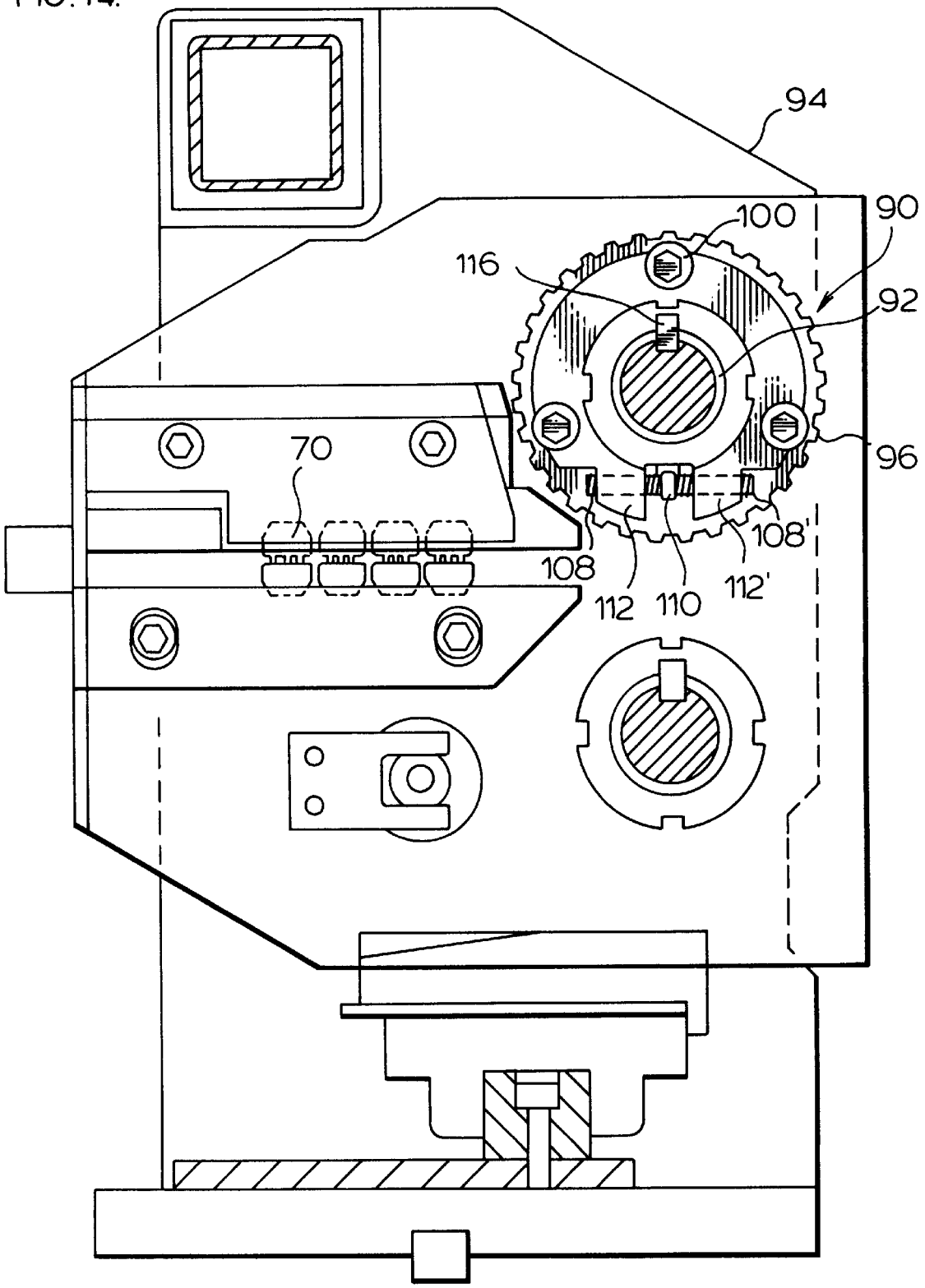
FIG. 14 is a side elevation of a sprocket wheel of the invention having a sprocket rim angularly adjustable on the hub of the sprocket wheel.
Figure 15:
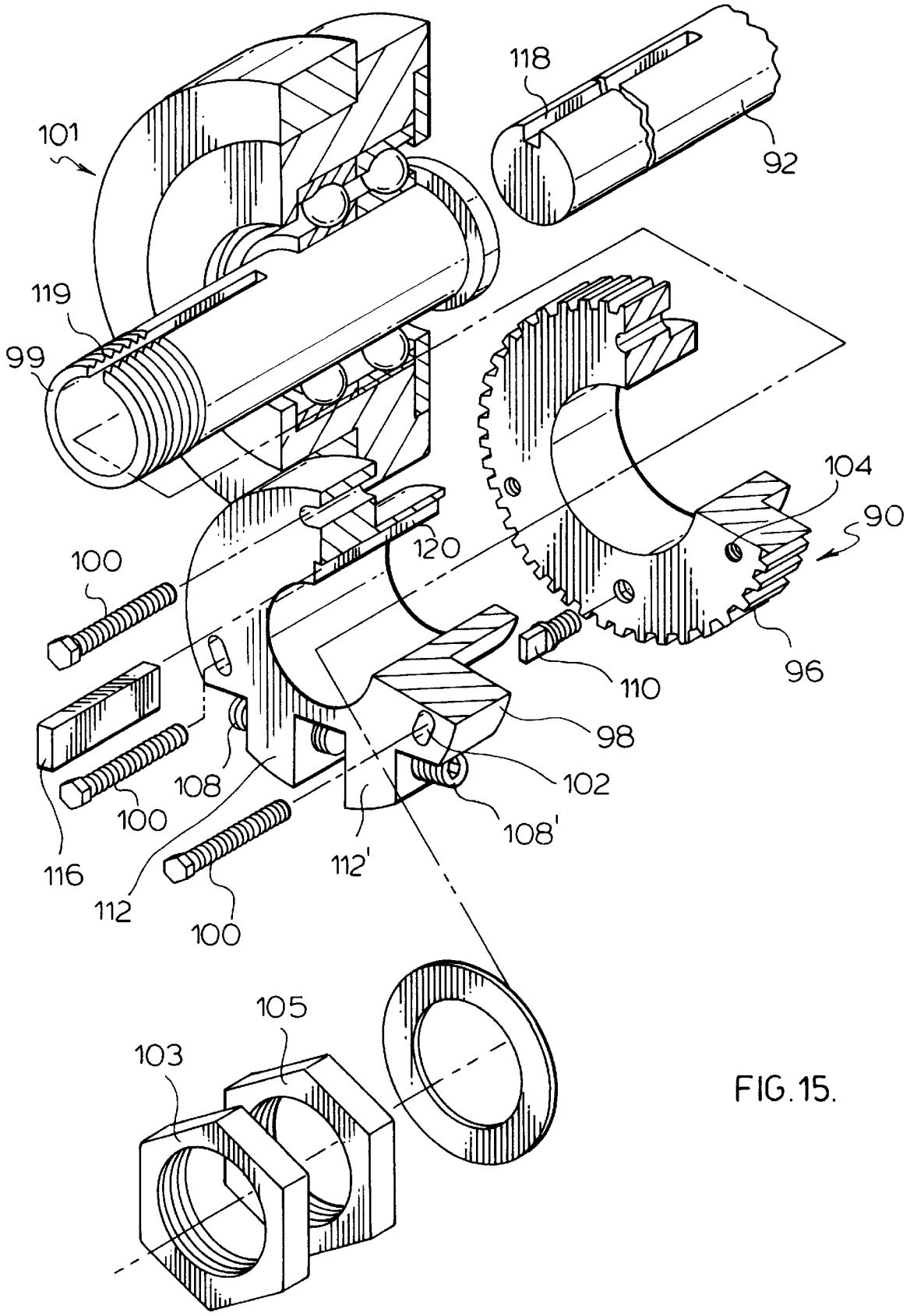
FIG. 15 is an exploded perspective view of the adjustable sprocket wheel shown in FIG. 14.

FIG. 14 illustrates a sprocket wheel 90 mounted for rotation on shaft 92 journalled in machine 94 for driving an endless chain having links 70. With reference to FIG. 15, sprocket wheel 90 comprises toothed rim 96 affixed to intermediate hub 98 by a plurality of equispaced bolts 100 which pass through angular slots 102 in hub 98 into threaded holes 104 in sprocket wheel 90. Hub 98 is adjustably mounted on sprocket wheel 90 for angular adjustment thereon by bolts 108 and 108' bearing against stop pin 110 extending from sprocket wheel 90. Rotation of bolt 108 in one direction and bolt 108' in the other direction cause sprocket wheel 90 to rotate relative to hub 98 by exerting pressure on stop pin 110 by bolts 108 and 108' in wings 112, 112'. Hub 98 is keyed onto shaft 92 by key 116 in keyways 118, 120.

The angular adjustment of sprocket wheel 90 thus can be effected by loosening of bolts 100 for rotation of hub 98 relative to toothed rim 96, within the limits of slots 102. The upper chain thus can be synchronized with the lower chain by means of angular adjustment of sprocket wheel 90.

The present invention provides a number of important advantages. The need for side-edge upturned flanges or preformed protrusions which must be severed from the strip after expansion into mesh is obviated. This not only avoids the need for the step of trimming the side edges, and its attendant costs, but substantially reduces the undesirable production of scrap material which must be chopped and recycled. Quick and facile external access to the die springs on the upper guide bars is permitted, allowing replacement of die springs when changing between soft low strength lead alloys to hard high strength lead alloys.

It will be understood, of course, that modifications can be made in the embodiments of the invention illustrated and described herein without departing from the scope and purview of the invention as defmed by the appended claims.

We claim:

1. An apparatus for expanding slit metal strip having opposite, longitudinal planar side edges in which gripping and guiding means engage the opposite longitudinal side edges of the strip and advance said edges in diverging paths for progressively laterally expanding the strip comprising two spaced apart pairs of diverging, opposed endless chains, one chain in each pair of opposed endless chains having a longitudinal recess adjacent a longitudinal planar side edge of the strip for receiving the longitudinal planar side edge of the strip therein, and the opposed chain in the said pair of opposed endless chains having a plurality of equispaced sharp projections extending partially into the longitudinal recess for penetrating and gripping the longitudinal side edge of the strip whereby the longitudinal planar side edges of the strip are advanced in diverging lateral paths for expanding the strip.

2. An apparatus as claimed in claim 1, in which each chain in each pair of opposed endless chains comprises a plurality of links and in which the longitudinal recess for receiving the longitudinal planar side edge of the strip is at least one link wide.

3. An apparatus as claimed in claim 1, in which each chain in each pair of opposed endless chains is a multiple link chain comprising six or eight parallel side-by-side links and in which the longitudinal recess for receiving the longitudinal planar side edge of the strip is two links wide.

4. An apparatus as claimed in claim 2, in which the sharp projections are in the form of v-shaped teeth, or knife edges having an acute included angle of between 45° and 60°.

5. An apparatus as claimed in claim 4, in which the teeth have a length of about 0.060 inch and the recess for receiving the teeth has a depth of about 0.070 inch.

6. An apparatus as claimed in claim 2, in which the sharp projections are in the form of chisel sharped teeth and having an acute included angle of between 30° and 45°.

7. An apparatus as claimed in claim 6, in which the teeth have a length of about 0.060 inch, and in which the recess for receiving the teeth has a depth of about 0.070 inch.

8. An apparatus as claimed in claim 2, which additionally comprises a frame, a pair of opposed, spaced-apart guide bars and guide bar holders mounted on said frame on each side thereof for receiving the pair of said diverging, opposed endless chains for guided travel, means for rigidly mounting one of said guide bars on the frame, and means for resiliently mounting the other of said guide bars on the frame for biasing one of the said guide bars towards the other.

9. An apparatus as claimed in claim 8, in which said guide bars and guide bar holders have side extensions for providing lateral support to the chains during expansion of the strip.

10. An apparatus as claimed in claim 9, in which the means for resiliently mounting the other of the guide bar comprises a stationary guide member rigidly mounted on the frame spaced from and parallel to the resiliently-mounted guide bar, said stationary guide member having a guide bar holder for laterally positioning and supporting the resiliently-mounted guide bar and having a plurality of holes equispaced along the length of the stationary guide member, a cap mounted on the stationary guide bar member having a plurality of holes, matching the holes equispaced along the stationary guide member, a bolt loosely mounted in each hole threaded into the guide bar and a compression spring positioned in each said hole concentric with the bolt abutting the cap at one end, whereby the resiliently-mounted guide bar is normally biased by the compression springs towards the stationary guide bar upon loosening of the bolts, and the resiliently-mounted guide bar is retracted away from the stationary guide bar by screwing of the bolts into the resiliently-mounted guide bar.

11. An apparatus as claimed in claim 10, in which the cap is removable for external access to and for replacement of the compression springs.

12. An apparatus as claimed in claim 8, additionally comprising means mounted on the frame for adjusting and maintaining the multiple links in the chains in each pair of opposed, multiple link endless chains in phase with and opposed to each other.

13. An apparatus as claimed in claim 12 in which said means for adjusting and maintaining the multiple links in the chains in each pair of opposed, multiple link endless chains in phase with and opposed to each other comprises means for linearly adjusting one chain in said pair of opposed, multiple link endless chains forward or backward relative to the other chain in said pair of opposed, multiple link endless chains by angularly advancing or retarding a sprocket wheel rotatably mounted on the frame about which said one chain travels.

14. In an apparatus for expanding slit metal strip as claimed in claim 13, said means for linearly adjusting one chain by angularly advancing or retarding a sprocket wheel comprising a toothed rim angularly adjustably mounted on the sprocket hub whereby the toothed rim can be rotably adjusted relative to the keyed sprocket hub.

15. An apparatus as claimed in claim 1, in which the plurality of equispaced sharp projections are teeth having a predetermined width in the one chain and in which the other chain of each pair of opposed endless chains has a longitudinal recess comprising a plurality of links pivotally interconnected a closely spaced linear distance apart, said width of the teeth in the one chain being greater than the said spaced distance between the links in the other chain whereby the teeth are always opposite to a surface of the links of the other chain having the longitudinal recess.

* * * * *